US011478071B2

(12) United States Patent
Leng

(10) Patent No.: US 11,478,071 B2
(45) Date of Patent: Oct. 25, 2022

(54) FOLDING STOOL OR FOLDING TABLE AND FOLDING FRAME THEREOF

(71) Applicant: New-Tec Integration (Xiamen) Co., Ltd., Fujian (CN)

(72) Inventor: Luhao Leng, Fujian (CN)

(73) Assignee: New-Tec Integration (Xiamen) Co., Ltd., Fujian (CN)

( * ) Notice: Subject to any disclaimer, the term of this patent is extended or adjusted under 35 U.S.C. 154(b) by 236 days.

(21) Appl. No.: 16/898,833

(22) Filed: Jun. 11, 2020

(65) Prior Publication Data

US 2020/0390233 A1 Dec. 17, 2020

(30) Foreign Application Priority Data

Jun. 17, 2019 (CN) ..... 201920909653.X

(51) Int. Cl.

| | |
|---|---|
| ***A47B 3/091*** | (2006.01) |
| ***A47B 3/087*** | (2006.01) |
| ***A47B 3/00*** | (2006.01) |
| *A47C 9/10* | (2006.01) |

(52) U.S. Cl.

CPC ..... *A47B 3/0915* (2013.01); *A47B 3/002* (2013.01); *A47B 3/087* (2013.01); *A47C 9/10* (2013.01)

(58) Field of Classification Search

CPC ..... A47B 3/002; A47B 3/087; A47B 3/0915; A47C 9/10

USPC ..... 108/166–169, 174

See application file for complete search history.

(56) References Cited

U.S. PATENT DOCUMENTS

| | | | | |
|---|---|---|---|---|
| 2,643,926 | A * | 6/1953 | Pucci | A47B 3/083 108/174 |
| 2013/0000528 | A1* | 1/2013 | Jin | A47B 3/0915 108/127 |
| 2015/0250302 | A1* | 9/2015 | Leng | A47B 13/08 428/172 |
| 2017/0013955 | A1* | 1/2017 | Lin | A47B 3/087 |

* cited by examiner

*Primary Examiner* — Matthew W Ing

(74) *Attorney, Agent, or Firm* — Cooper Legal Group LLC

(57) ABSTRACT

A folding stool or a folding table and a folding frame thereof. The folding frame includes a left frame, a right frame, and two middle support legs. A front end of an inner side of the left frame and a front end of an inner side of the right frame are provided with front hinge pieces that are hinged to each other, and a rear end of the inner side of the left frame and a rear end of the inner side of the right frame are provided with rear hinge pieces that are hinged to each other. Tops of the two middle support legs are respectively hinged with the front hinge pieces and the rear hinge pieces. Each of the two middle support legs is provided with a sliding sleeve.

16 Claims, 6 Drawing Sheets

FOLDING STOOL OR FOLDING TABLE AND FOLDING FRAME THEREOF

RELATED APPLICATION

This application claims priority to Chinese Patent Application 201920909653.X, filed on Jun. 17, 2019. Chinese Patent Application 201920909653.X is incorporated herein by reference.

FIELD OF THE DISCLOSURE

The present disclosure relates to a folding stool or folding table, and in particular relates to a folding frame of a folding stool or folding table.

BACKGROUND OF THE DISCLOSURE

If a height of a table is reduced, it becomes a stool. Similarly, if the height of the stool is increased, it becomes a table. The structure of a table and the structure of a stool are quite similar, so a structure can be interchangeably used as a table or a stool. An ordinary stool is likely to be seen as a table in the eyes of children.

The structure of a traditional table or stool comprises a board component and a plurality of legs under the board component, which are provided for support. Although this structure is relatively strong and does not generally easily deform, the structure takes up a lot of space during transportation and storage. In order to improve the portability of the table or stool, people have designed foldable tables and stools. For example, Chinese patent application number 94214433.3 discloses a portable, folding stool. Two stool surfaces are connected by hinges, and two pairs of legs are respectively connected to outer ends of the two stool surfaces. When not in use, the two pairs of legs can be rotated so as to cause the two pairs of legs to be folded under the two stool surfaces, and the two stool surfaces can also be folded at the hinges, thereby greatly reducing the occupied space.

However, when this folding stool is unfolded, a lower part of a connection of the two stool surfaces is in a suspended state. This area (the connection of the two stool surfaces) is a main component for a bearing capacity of the two stool surfaces. Therefore, the stability of the stool is not good, and the stool easily deforms and shakes. Although some people also considered adding a pair of legs to an inner end of the two stool surface, this structure results in the need to operate four pairs of legs when folding and unfolding. The operation is therefore cumbersome, and the overall structure is too complex.

BRIEF SUMMARY OF THE DISCLOSURE

The present disclosure provides a folding stool or a folding table and a folding frame thereof, which have a firm structure and are easy to use and operate. In order to solve the aforementioned technical problems, a first technical solution of the present disclosure is as follows.

A folding frame for a folding stool or folding table, comprises a left frame, a right frame, and two middle support legs. A front end of an inner side of the left frame and a front end of an inner side of the right frame are provided with front hinge pieces that are hinged to each other, and a rear end of the inner side of the left frame and a rear end of the inner side of the right frame are provided with rear hinge pieces that are hinged to each other. The two middle support legs are symmetrically disposed, and tops of the two middle support legs are respectively hinged with the front hinge pieces and the rear hinge pieces. Each of the two middle support legs is provided with a sliding sleeve, two ends of each of the sliding sleeves are respectively connected to the left frame and the right frame by a link rod, and connection points at two ends of each of the link rods are rotating hinge points.

In a preferred embodiment, rotation points of the two middle support legs, rotation points of the front hinge pieces, and rotation points of the rear hinge pieces are collinear.

In a preferred embodiment, the two middle support legs are respectively disposed on inner sides of the front hinge pieces and rear hinge pieces, and the link rods are respectively hinged with the inner side of the left frame and the inner side of the right frame.

In a preferred embodiment, a fixing rod is connected between the two middle support legs.

In a preferred embodiment, the left frame and the right frame are rectangular frames.

In a preferred embodiment, the left frame and the right frame are respectively provided with a crisscross reinforcing frame.

In a preferred embodiment, the folding frame further comprises a lock, and an elastic member. The lock and the elastic member are provided at a position of the front hinge pieces or the rear hinge pieces. One end of the lock is hinged to one of the front hinge pieces or one of the rear hinge pieces, and another end of the lock is driven by the elastic member to abut another one of the front hinge pieces or another one of the rear hinge pieces.

In order to solve the aforementioned technical problems, a second technical solution of the present disclosure is as follows.

A folding stool or folding table, comprises two boards, and a folding frame. The folding frame comprises a left frame, a right frame, and two middle support legs. A front end of an inner side of the left frame and a front end of an inner side of the right frame are provided with front hinge pieces that are hinged to each other, and a rear end of the inner side of the left frame and a rear end of the inner side of the right frame are provided with rear hinge pieces that are hinged to each other. The two middle support legs are symmetrically disposed, tops of the two middle support legs are respectively hinged with the front hinge pieces and the rear hinge pieces. each of the two middle support legs is provided with a sliding sleeve, two ends of each of the sliding sleeves are respectively connected to the left frame and the right frame by a link rod, and connection points at two ends of each of the link rods are rotating hinge points. The left frame and the right frame are respectively disposed on a periphery of a bottom surface of a corresponding one of the two boards.

In a preferred embodiment, each of the two boards comprises an upper plastic blister board and a lower plastic blister board bonded under the upper plastic blister board.

In a preferred embodiment, a top surface of the lower plastic blister board is provided with a protruding platform to support the upper plastic blister board.

Compared with existing techniques, the technical solution of the present disclosure has the following advantages.

The left frame and the right frame are rotatably connected by the front hinge pieces and the rear hinge pieces, which are disposed opposite to each other. Each of the front hinge pieces and the rear hinge pieces is additionally provided with a middle support leg. The middle support leg can support the inner side of the left frame and the inner side of the right frame so that a middle of the folding frame is not suspended, which greatly increases the strength and bearing capacity of the folding frame. Secondly, a sliding sleeve is provided on each of the middle support legs, and link rods are hinged symmetrically on the sliding sleeves. The link rods are hinged with the left frame and the right frame respectively. When folding, a person only needs to rotate the left frame or the right frame, the sliding sleeves slide along the middle support legs, and the left frame and the right frame will rotate relative to the middle support legs. Similarly, when unfolding, the left frame and the right frame will also be concurrently unfolded outward with respect to the middle support legs, and there is no need to unfold the middle support legs, making the structure very convenient to use.

The rotation points of the middle support legs, the rotation points of the front hinge pieces, and the rotation points of the rear hinge pieces are collinear to ensure smooth folding and unfolding.

The two middle support legs are respectively disposed on the inner sides of the front hinge pieces and the rear hinge pieces, and the link rods are hinged to the inner side of the left frame and the inner side of the right frame. After folding, the middle support legs and the link rods can be completely contracted into the left frame and the right frame to reduce the thickness after folding.

One end of the lock is hinged on a front hinge piece or a rear hinge piece, and the other end of the lock abuts another front hinge piece or another rear hinge piece when driven by the elastic member. Therefore, rotation between the two front hinge piece and the two rear hinge pieces is limited and the folding frame is stably maintained in an unfolded state. To fold the folding frame, the lock needs to be unlocked, so that the lock no longer abuts the other front hinge piece or the other rear hinge piece.

BRIEF DESCRIPTION OF THE DRAWINGS

The present disclosure will be further described below with reference to the drawings and embodiments.

DETAILED DESCRIPTION OF THE EMBODIMENTS

Embodiment 1

Figure 1:
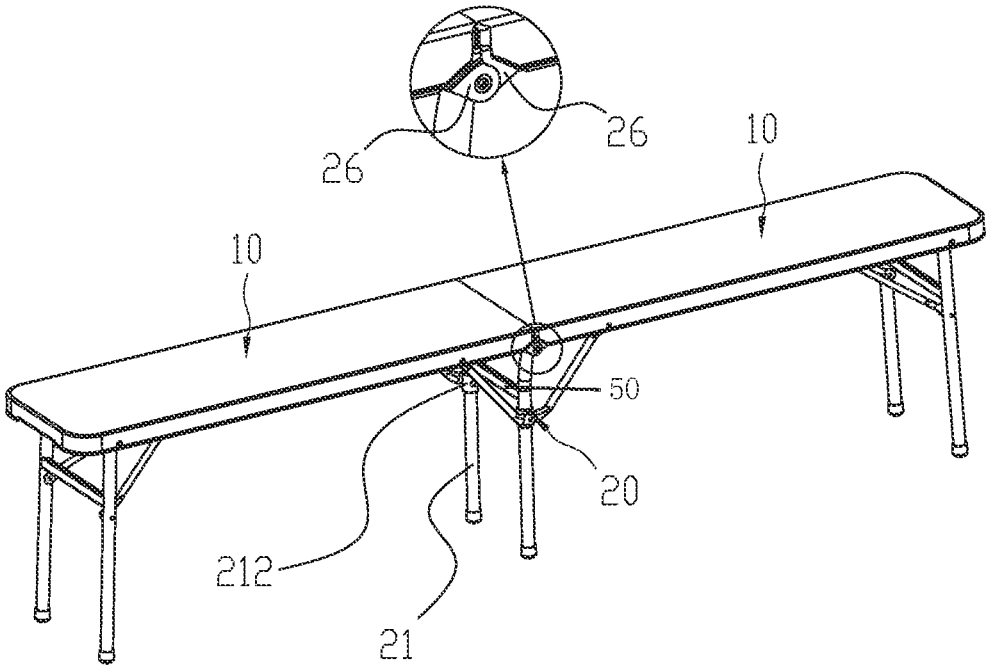
FIG. 1 is a perspective view of a folding stool of Embodiment 1 of the present disclosure.
Figure 2:
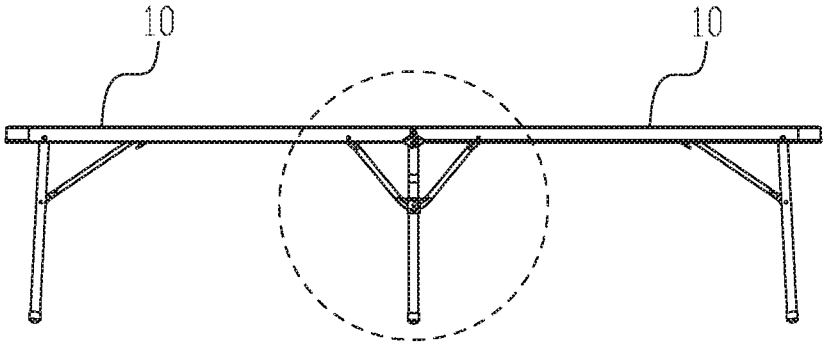
FIG. 2 is a front view of the folding stool shown in FIG. 1.
Figure 3:
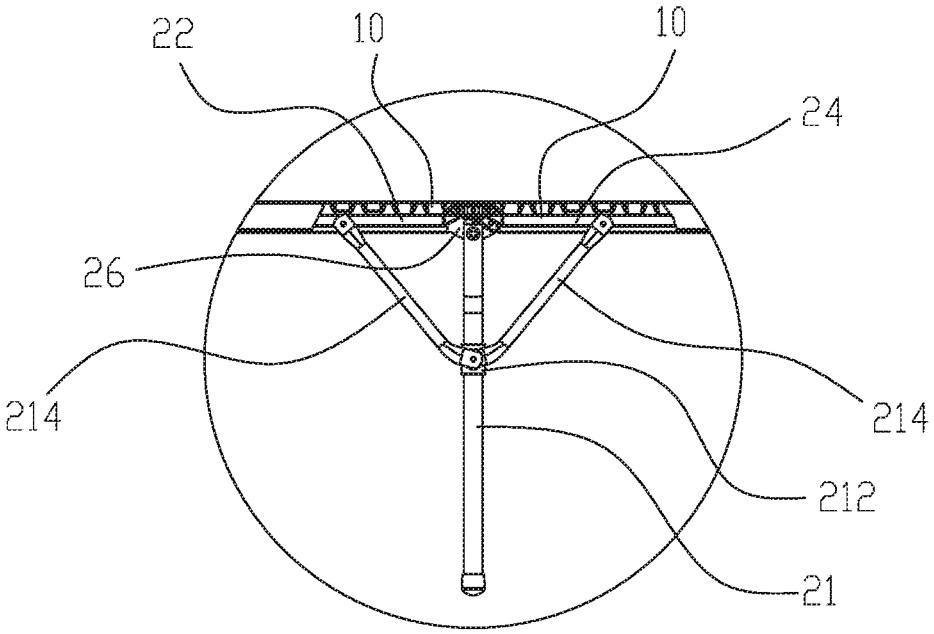
FIG. 3 is an enlarged view of a region in the circle in FIG. 2, a portion thereof being cut away.
Figure 4:
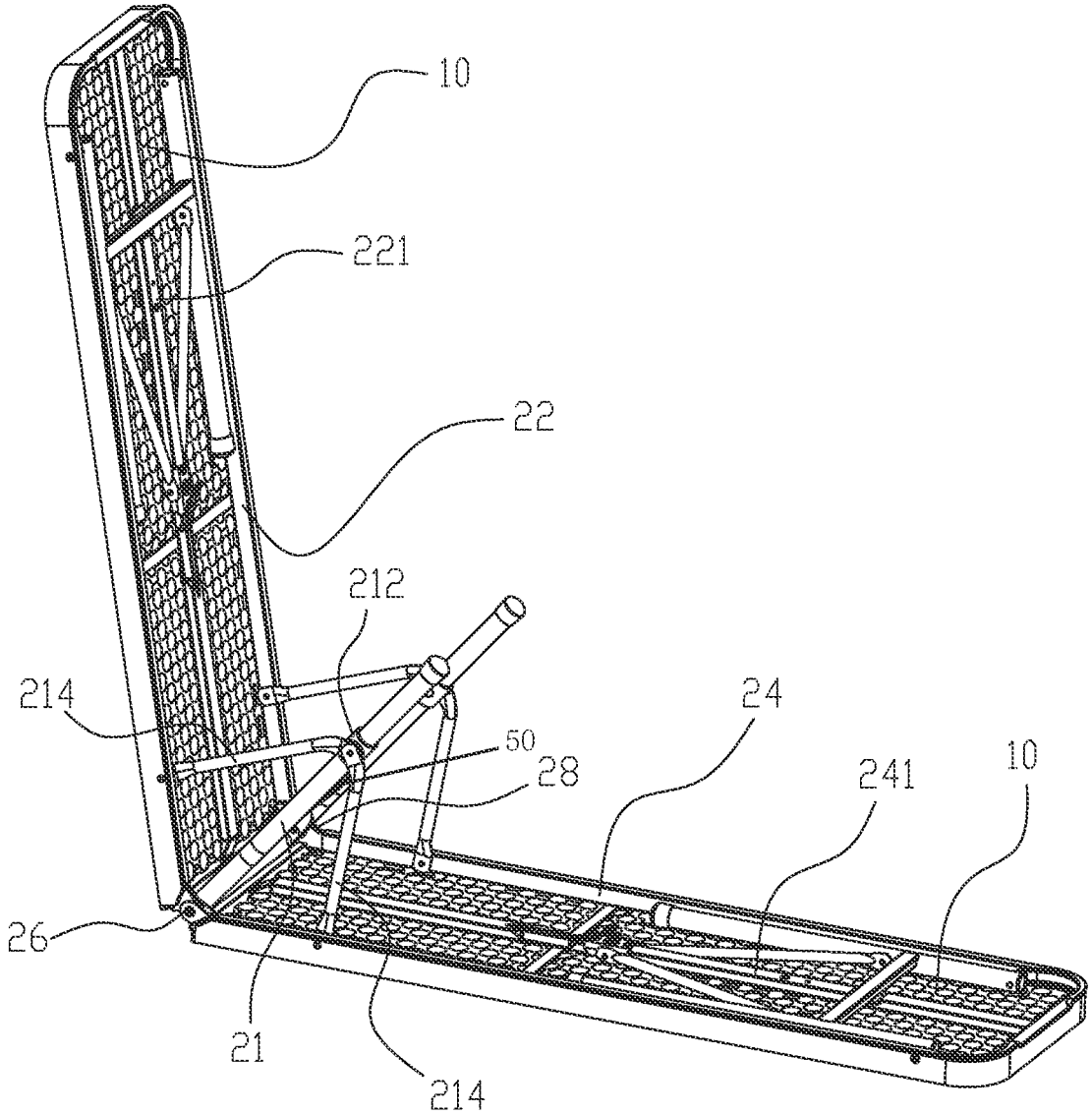
FIG. 4 is a perspective view of the folding stool shown in FIG. 1 in a partially folded state.
Figure 5:
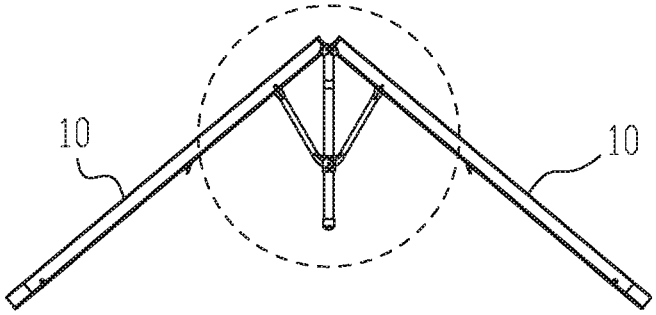
FIG. 5 is a front view of the folding stool shown in FIG. 4 in the partially folded state.
Figure 6:
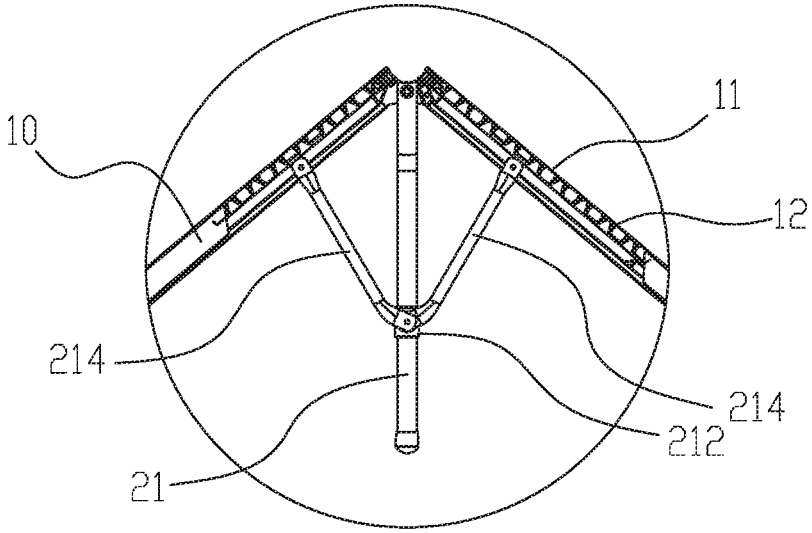
FIG. 6 is an enlarged view of a region in the circle in FIG. 5, a portion thereof being cut away.
Figure 7:
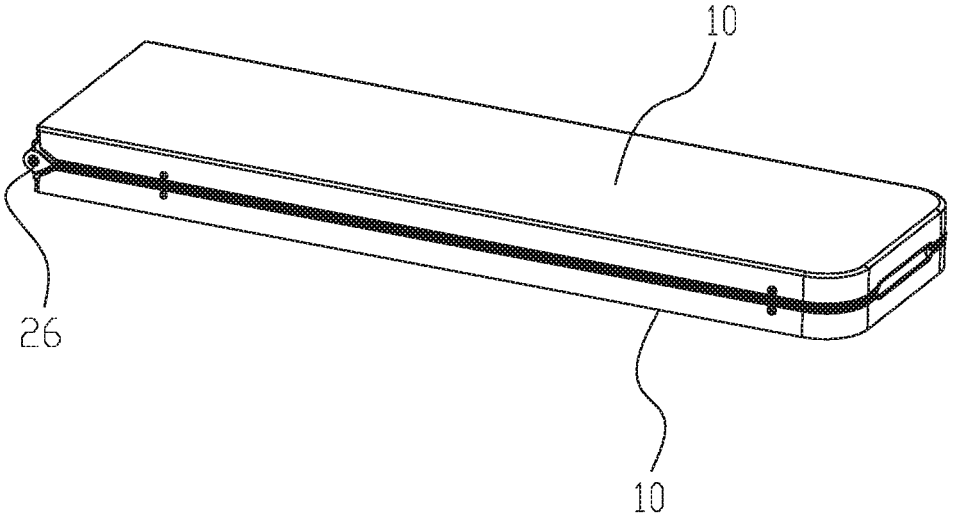
FIG. 7 is a perspective view of the folding stool shown in FIG. 1 in a completely folded state.
Figure 8:
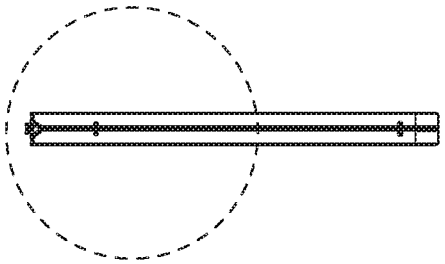
FIG. 8 is a front view of the folding stool shown in FIG. 7 in the completely folded state.
Figure 9:
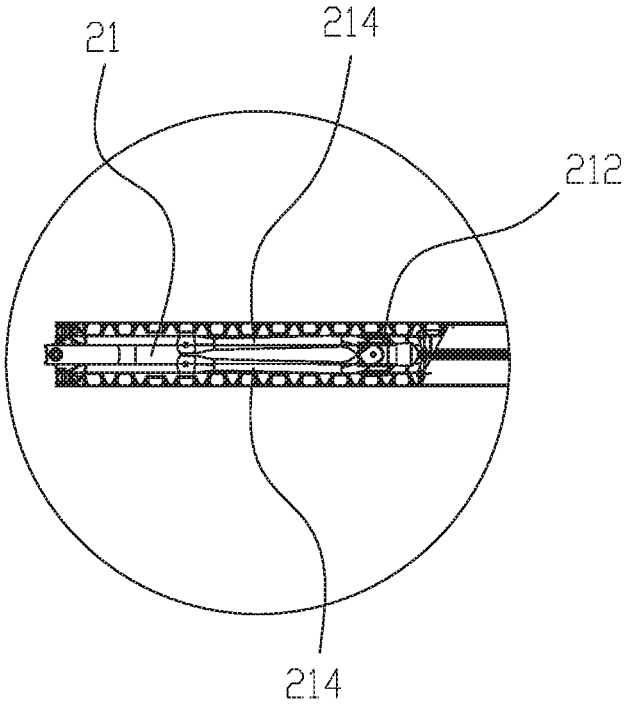
FIG. 9 is an enlarged view of a region in the circle in FIG. 8, a portion thereof being cut away.

Referring to FIGS. 1 to 9, a folding stool comprises two boards 10 and a folding frame 20. The folding frame 20 comprises a left frame 22 and a right frame 24. The left frame 22 and the right frame 24 are respectively disposed on a periphery of a bottom surface of a corresponding one of the two boards 10. Inner sides of front ends of the left frame 22 and the right frame 24 are provided with front hinge pieces 26 that are hinged to each other. That is, the left frame 22 and the right frame 24 are respectively provided with a front hinge piece 26, and the two front hinge pieces 26 are hinged together. Inner sides of rear ends of the left frame 22 and the right frame 24 are provided with rear hinge pieces 28 that are hinged to each other. That is, the left frame 22 and the right frame 24 are respectively provided with a rear hinge piece 28, and the two rear hinge pieces 28 are hinged together. In this way, the left frame 22 and the right frame 24 can be folded or unfolded relative to each other. In the present embodiment, the inner side refers to a side where the left frame 22 and the right frame 24 are close to each other (i.e., the inner side of the left frame 22 faces the right frame 24 and the inner side of the right frame 24 faces the left frame 22), and an outer side refers to a side where the left frame 22 and the right frame are away from each other (i.e., the outer side of the left frame 22 faces away from the right frame 24 and the outer side of the right frame 24 faces away from the left frame 22). The left frame 22 and the right frame 24 are also provided with support legs disposed below the outer sides of the left frame 22 and the right frame 24. The support legs are conventional and will not be described.

The folding frame 20 further comprises two middle support legs 21 symmetrically disposed. Tops of the two middle support legs 21 are hinged with the front hinge pieces 26 and the rear hinge pieces 28 respectively. The middle support legs 21 are each provided with a sliding sleeve 212. That is, both middle support legs 21 are provided with a sliding sleeve 212. Each of the sliding sleeves 212 is respectively connected to the left frame 22 and the right frame 24 by a link rod 214. That is, each of the sliding sleeves 212 is connected to two link rods 214, and the two link rods 214 are respectively disposed corresponding to the left frame 22 and the right frame 24. Connection points at two ends of each of the link rods 214 are rotating hinge points. That is, one end of each of the link rods 214 is hinged with the sliding sleeve 212, and the other end of each of the link rods 214 is hinged with the left frame 22 or the right frame 24.

When folded, the left frame 22 and the right frame 24 are centered on rotation points of the front hinge pieces 26 and the rear hinge pieces 28 and are concurrently brought close to the two middle support legs 21 until they are stacked together. Each of the sliding sleeves 212 slides from an upper part of a corresponding one of the two middle support legs 21 to a lower part of the corresponding one of the two middle support legs 21.

In some embodiments, the rotation points of the two middle support legs 21, rotation points of the two front hinge pieces 26, and rotation points of the two rear hinge pieces 28 are collinear.

In some embodiments, the two middle support legs 21 are respectively disposed on inner sides of the front hinge piece 26 and the rear hinge piece 28. That is, in a direction facing toward a center of the folding frame 20. Each of the link rods 214 is hinged to the inner side of the left frame 22 or the right frame 24.

In some embodiments, a fixing rod 50 is connected between the two middle support legs 21 so that the two middle support legs 21 can form an integral unit.

The left frame 22 and the right frame 24 are rectangular frames. The left frame 22 is provided with a crisscross reinforcing frame 221, and the right frame 24 is provided with a crisscross reinforcing frame 241. The crisscross reinforcing frames 221, 241 improve a carrying capacity of the two boards 10.

In some embodiments, a lock and an elastic member are provided at a position of the front hinge pieces 26 or the rear hinge pieces 28. One end of the lock is hinged to one of the front hinge pieces 26 or one of the rear hinge pieces 28, and another end of the lock is driven by the elastic member to abut another one of the front hinge pieces or another one of the rear hinge pieces to prevent the front hinge pieces 26 and the rear hinge pieces 28 from accidentally rotating.

Each of the boards 10 comprises an upper plastic blister board 11 and a lower plastic blister board 12 bonded together. A top surface of the lower plastic blister board 12 is provided with a protruding platform to support the upper plastic blister board 11.

It can be understood that the structure of this embodiment can be applied to a folding table. That is, the folding table has the same structure as that of the folding stool of this embodiment.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A folding frame for a folding stool or folding table, comprising:
- a left frame,
- a right frame, and
- two middle support legs, wherein:
  - a front end of an inner side of the left frame and a front end of an inner side of the right frame are provided with front hinge pieces,
  - a rear end of the inner side of the left frame and a rear end of the inner side of the right frame are provided with rear hinge pieces,
  - the two middle support legs are symmetrically disposed,
  - a top of each of the two middle support legs is respectively hinged with a corresponding one of the front hinge pieces and a corresponding one of the rear hinge pieces,
  - each of the two middle support legs is provided with a sliding sleeve,
  - two ends of the sliding sleeve are respectively connected to the left frame and the right frame by a link rod,
  - connection points at two ends of the link rod are rotating hinge points,
  - the left frame, the right frame, and the two middle support legs define an interlocked connection due to the sliding sleeve and the link rod,
  - when one of the left frame or the right frame is folded, the sliding sleeve moves downward to drive another of the left frame or the right frame to be synchronously folded, and
  - when the one of the left frame or the right frame is unfolded, the sliding sleeve moves upward to drive the another of the left frame or the right frame to be synchronously unfolded.

2. The folding frame according to claim 1, wherein rotation points of the two middle support legs, rotation points of the front hinge pieces, and rotation points of the rear hinge pieces are collinear.

3. The folding frame according to claim 2, wherein:
- the two middle support legs are respectively disposed on inner sides of the front hinge pieces and rear hinge pieces, and
- the link rods are respectively hinged with the inner side of the left frame and the inner side of the right frame.

4. The folding frame according to claim 2, wherein a fixing rod is connected between the two middle support legs.

5. The folding frame according to claim 1, wherein:
- the two middle support legs are respectively disposed on inner sides of the front hinge pieces and rear hinge pieces, and
- the link rods are respectively hinged with the inner side of the left frame and the inner side of the right frame.

6. The folding frame according to claim 1, wherein a fixing rod is connected between the two middle support legs.

7. The folding frame according to claim 1, wherein the left frame and the right frame are rectangular frames.

8. The folding frame according to claim 7, wherein the left frame and the right frame are respectively provided with a crisscross reinforcing frame.

9. A folding stool or folding table, comprising:
- two boards, and
- a folding frame comprising:
  - a left frame,
  - a right frame, and
  - two middle support legs, wherein:
    - a front end of an inner side of the left frame and a front end of an inner side of the right frame are provided with front hinge pieces,
    - a rear end of the inner side of the left frame and a rear end of the inner side of the right frame are provided with rear hinge pieces,
    - the two middle support legs are symmetrically disposed,
    - a top of each of the two middle support legs is respectively hinged with a corresponding one of the front hinge pieces and a corresponding one of the rear hinge pieces,
    - each of the two middle support legs is provided with a sliding sleeve,
    - two ends of each of the sliding sleeves are respectively connected to the left frame and the right frame by a link rod,
    - connection points at two ends of the link rod are rotating hinge points,
    - the left frame and the right frame are respectively disposed on a periphery of a bottom surface of a corresponding one of the two boards,
    - the left frame, the right frame, and the two middle support legs define an interlocked connection,
    - when one of the left frame or the right frame is folded, the sliding sleeve moves downward to drive another of the left frame or the right frame to be synchronously folded, and
    - when the one of the left frame or the right frame is unfolded, the sliding sleeve moves upward to drive the another of the left frame or the right frame to be synchronously unfolded.

10. The folding stool or folding table according to claim 9, wherein each of the two boards comprises an upper plastic blister board and a lower plastic blister board bonded under the upper plastic blister board.

11. The folding stool or folding table according to claim 10, wherein a top surface of the lower plastic blister board is provided with a protruding platform to support the upper plastic blister board.

12. The folding frame according to claim 9, wherein rotation points of the two middle support legs, rotation points of the front hinge pieces, and rotation points of the rear hinge pieces are collinear.

13. The folding frame according to claim 9, wherein:

the two middle support legs are respectively disposed on inner sides of the front hinge pieces and rear hinge pieces, and the link rods are respectively hinged with the inner side of the left frame and the inner side of the right frame.

14. The folding frame according to claim 9, wherein a fixing rod is connected between the two middle support legs.

15. The folding frame according to claim 9, wherein the left frame and the right frame are rectangular frames.

16. The folding frame according to claim 15, wherein the left frame and the right frame are respectively provided with a crisscross reinforcing frame.

* * * * *